United States Patent [19]

Morris et al.

[11] 4,443,222

[45] Apr. 17, 1984

[54] ZINC PYRITHIONE PROCESS TO IMPART ANTIMICROBIAL PROPERTIES TO TEXTILES

[75] Inventors: Cletus E. Morris; Clark M. Welch, both of Metairie, La.

[73] Assignee: The United States of America as represented by the Secretary of Agriculture, Washington, D.C.

[21] Appl. No.: 527,894

[22] Filed: Aug. 30, 1983

[51] Int. Cl.[3] ..... D06M 13/28; D06M 13/38

[52] U.S. Cl. ..... 8/189; 427/392; 427/396

[58] Field of Search ..... 8/189; 427/392, 396

[56] References Cited

U.S. PATENT DOCUMENTS 3,940,842 2/1976 Grand ..... 424/245

FOREIGN PATENT DOCUMENTS 1202716 8/1970 United Kingdom .
1390004 4/1975 United Kingdom .

OTHER PUBLICATIONS

Vigo, Tyrone L.; "Antibacterial Finishing of Textiles, Potential, Problems, Progress, and Prospects", vol. 6, pp. 455–458 (1976).

Bertioniere, Noelie and Stanley P. Rowland; "Improved Durable-Press Cotton via Polymeric N-Methylol Reagents" Textile Research Journal, vol. 46, No. 5, (May 1976).

*Primary Examiner*—Maria Parrish Tungol
*Attorney, Agent, or Firm*—M. Howard Silverstein; David G. McConnell; Raymond C. Von Bodungen

[57] ABSTRACT

A process by which 1-hydroxy-2-pyridinethione (pyrithione) can be deposited in cellulosic textiles in a water-insoluble form is disclosed. A polyamine is used to keep a zinc complex of pyrithione in aqueous solution prior to and during its application to textiles; when the solution also contains urea, heating fabric impregnated with the solution converts the pyrithione complex to an insoluble material. Fabric treated by the process has high bacteriostatic and fungistatic activity, and retains antimicrobial properties after repeated laundering.

5 Claims, No Drawings

ZINC PYRITHIONE PROCESS TO IMPART ANTIMICROBIAL PROPERTIES TO TEXTILES

BACKGROUND OF THE INVENTION (1) Field of the Invention

This invention relates to a process for imparting antibacterial and antifungal properties to cellulosic textiles. More particularly, it relates to deposition of 1-hydroxy-2-pyridinethione (hereinafter referred to as pyrithione) in cellulosic textiles in a water-insoluble form.

(2) Description of the Prior Art

Few of the many processes previously used in antimicrobial treatment of textiles have produced bacteriostatic or fungistatic activity that was found to be durable to repeated launderings. The prior art on antibacterial finishing of textiles has been reviewed by Vigo, *CHEMTECH* 6, 455-8 (1976).

It is well known that both pyrithione and many of its salts and metal complexes have high, broad-spectrum anti-bacterial and antifungal activity. The present invention utilizes a zinc complex of pyrithione, bis(N-oxopyridine-2-thionato)zinc(II) (hereinafter referred to as zinc pyrithione), as the antimicrobial agent. Zinc pyrithione is widely used in hair care products, and the safety of products containing it is therefore well established.

A disadvantage of zinc pyrithione for use in textile treatments is its very low solubility in water. Doerr, British Pat. No. 1,390,004, has shown that addition of a dispersion of zinc pyrithione in an aqueous solution of a quaternary ammonium compound during a rinse step of a laundering operation can give laundered fabrics a high level of antimicrobial properties. Gerstein, British Pat. No. 1,202,716, has shown that zinc pyrithione can be solubilized by adding a polyethylenimine to a suspension of the pyrithione complex in water. Grand, U.S. Pat. No. 3,940,482, described a similar process for solubilizing zinc pyrithione by adding an aliphatic polyamine of relatively low molecular weight ($H_2N(CH_2CH_2NH)_nH$, where n=1–5) to the aqueous system. The latter patent suggests that the solutions obtained are useful in compositions for treating textiles, such as diapers. However, the prior art suggests no method whereby zinc pyrithione can be used to give textiles antimicrobial properties that are durable to laundering. Zinc pyrithione deposited on a fabric surface by treatment with a dispersion of the compound would be rapidly removed by laundering. Zinc pyrithione that had been solubilized by a polyamine and then deposited in fabric by impregnating it with a zinc pyrithione solution and drying would be removed even more easily by washing or leaching. The high durability of the antibacterial activity imparted by treatment with the zinc pyrithione compositions used in the present invention is a major advantage over the processes of the prior art.

SUMMARY OF THE INVENTION

Applicant discloses a process for imparting to cellulosic textiles antimicrobial properties that are durable to laundering. The process comprises impregnating a cellulosic textile material with a solution of zinc pyrithione, sufficient amounts of polyamine capable of solubilizing the pyrithione complex per part of zinc pyrithione, and sufficient amounts of urea to provide one urea molecule for each primary and secondary amino group in the polyamine. The textile is then heated at sufficient temperature to drive off moisture and complete the chemical reaction.

DESCRIPTION OF THE PREFERRED EMBODIMENTS

The processes of the present invention utilize a polyamine, such as a polyethylenimine, to keep zinc pyrithione in solution prior to and during its application to textiles, but enable it to be converted to an insoluble material with high antimicrobial activity. This is accomplished by addition of urea to the aqueous zinc pyrithione-polyamine solution, which is then applied to fabric and heat-dried on it. It has been reported by Bertoniere and Rowland, *Text. Res. J.* 46, 311–318 (1976), that when a polyethylenimine is heated with an aqueous solution of urea reactions of the following type take place:

$$(-NHCH_2CH_2-)_x + H_2NCONH_2 \longrightarrow (-\underset{\underset{CONH_2}{|}}{N}-CH_2CH_2-)_x + NH_3$$

It is hypothesized that when fabric impregnated with a solution containing zinc pyrithione, a polyamine, and urea is heat-dried such reactions take place and that the carbamoyl groups introduced into the polyamine make it a less effective complexing agent for zinc, thereby decreasing its ability to solubilize the zinc pyrithione. Unexpectedly, however, determinations of sulfur and zinc in the treated fabrics showed that the treatment did not merely deposit zinc pyrithione in them. The atomic ratio of sulfur to zinc in the treated fabrics varied from 4:1 to 28:1, whereas that in zinc pyrithione is only 2:1. Therefore, at least part of the pyrithione bound in the fabric is not directly associated with zinc.

Fabrics treated by these processes inhibit the growth of infection-producing bacteria and fungi. The antibacterial activity of such fabrics is durable to repeated laundering; durability of their antifungal activity to laundering is more limited.

In the description that follows, all percentages and parts are by weight.

In the application of the invention, zinc pyrithione is applied to fabric from an aqueous solution containing zinc pyrithione, at least 1.5 parts of polyamine per part of zinc pyrithione, and at least enough urea to make one molecule of urea available for reaction with each primary and secondary amino group in the polyamine. The concentration of zinc pyrithione needed in the solution will depend on the desired level of antimicrobial activity in the treated fabric and the desired durability to laundering, but generally concentrations in the range of about 0.5–4% are preferred.

As is known in the art, polyamines that can be used to solubilize zinc pyrithione include polyethylenimines, polypropylenimines, and compounds of lower molecular weight that may be considered to be derived from sections of a polyethylenimine molecule, such as tris(2-aminoethyl)amine and tetraethylene pentamine. Any such polyamines in which a majority of the amino groups are primary or secondary, and hence capable of reacting with urea, are employable in the invention. The preferred process uses a polyethylenimine. As the ability of polyethylenimines to solubilize zinc pyrithione decreases somewhat with increasing molecular weight, polyethylenimines of relatively low molecular weight (about 600–1200) are particularly preferred. We have found that when a commercially available polyethylenimine designated PEI-12, which implies an average molecular weight of 1200, is used at least 1.5 parts of the polyamine is needed to solubilize one part of zinc pyrithione. Two parts of PEI-12 per part of zinc pyrithione is preferred for rapid solubilization.

Polyethylenimines are branched polymers that contain primary, secondary and tertiary amino groups in the approximate raio 1:2:1. Therefore, about 75% of the amino groups in the polymer are capable of reacting with urea, and the theoretical minimum amount of urea required to attach one carbamoyl group to each reactive amino group is 0.75 molecule of urea per ethylenimine unit. It has been found that presence in the solution of one molecule of urea per ethylenimine unit (1.4 parts of urea per part of polyethylenimine) enables a substantial amount of pyrithione to be deposited in the fabric in a water-insoluble form, but that 2.8 parts of urea per part of polyethylenimine is a preferable ratio.

The solution may be applied to fabric by any convenient means. The most common method is by padding, where the fabric is passed into the solution and then between squeeze rolls to remove excess solution. In our application by padding, the fabric retained an amount of solution equal to 87–97% of dry fabric weight.

The impregnated fabric is dried at a temperature above 100° C. to produce the desired chemical reaction. The dried fabric is preferably washed to remove residual water-soluble products and redried by any convenient means.

The following examples illustrate but do not limit the scope of this invention. The desized, scoured, and bleached cotton printcloth used weighed 3.2 oz/yd$^2$. Durability of the fabric finishes was determined by laundering as described in AATCC Test Method 124-1978, with the machine set for hot wash and warm rinse. A Quinn method (AATCC Test Method 100-1981) was used to determine bacteriostatic activity of the fabrics against *Staphylococcus aureus* and fungistatic activity against *Trichophyton mentagrophytes.* A convenient qualitative test for pyrithione in treated fabric consisted of placing a drop of 10% aqueous $FeNH_4(SO_4)_2.12H_2O$ on the fabric; a gray color was a positive test for presence of pyrithione. However, this chemical test was not sensitive enough to detect pyrithione in some fabrics that had excellent antimicrobial properties.

EXAMPLE 1

A solution was prepared that contained 0.82 g of zinc pyrithione (purity approximately 95%), 1.66 g of a polyethylenimine designated PEI-12, 20.26 g of water, and 2.30 g of urea. A swatch of cotton fabric was padded to about 90% wet pickup with the solution, dried at 160° C. for 5 min. in a forced-draft oven, rinsed for 30 min in hot running tap water, and redried at 80° C. After air-equilibration at ordinary humidity, the fabric had a weight gain of 2.0%. It contained 0.27% nitrogen, 0.03% zinc, and less tha 0.1% sulfur, and gave a weakly positive $Fe^{3+}$ color test for pyrithione. In a Quinn test with *S. aureus,* this fabric gave a 100% reduction in the number of bacterial colonies observed with untreated fabric.

The results show that even when the treating bath contained only 1.4 parts of urea per part of polyethylenimine enough pyrithione was insolubilized in the fabric to give it excellent antibacterial activity.

EXAMPLE 2

Swatches of cotton fabric were treated by the procedure of Example 1 with a solution containing 4.11 g of zinc pyrithione, 8.24 g of PEI-12, 89.74 g of water, and 22.92 g of urea. The wet pickups were 96–97%, and the treated swatches had weight gains of 2.9–3.0%. Properties of the treated fabric before and after repeated laundering are summarized in Table I.

TABLE I

PROPERTIES OF FABRIC TREATED WITH A SOLUTION CONTAINING 2 PARTS OF POLYETHYLENIMINE PER PART OF ZINC PYRITHIONE

| Launderings | Zn, %[a] | S, %[b] | N, % | $Fe^{3+}$ color test | Growth inhibition[c] *S. aureus* | Growth inhibition[c] *T. mentagrophytes* |
|---|---|---|---|---|---|---|
| 0 | 0.20 | 0.41 | 0.44 | Pos. | 100% | Complete |
| 1 | ND | 0.19 | 0.31 | Pos. | 100 | — |
| 5 | ND | (0.05) | 0.23 | Neg. | 100 | 13 |
| 10 | ND | (0.01) | 0.22 | Neg. | 100 | None |
| 20 | ND | (0.10) | 0.13 | — | 100 | None |
| 50 | ND | (0.10) | 0.12 | — | 100 | None |

[a]ND means not detected.
[b]Values in parentheses are considered too low to be meaningful.
[c]Reduction in number of colonies, as compared with number of colonies on cotton control fabric.

The results show that increasing the ratio of urea to polyethylenimine in the treating bath from 1.4:1 to 2.8:1 substantially increased the amount of pyrithione insolubilized in the fabric. The results also show that the treated fabric had excellent antibacterial and antifungal activity, and that its bacteriostatic properties were highly durable to repeated laundering.

EXAMPLE 3

Swatches of cotton fabric were treated by the procedure of Example 1 with solutions containing 3.3 parts of zinc pyrithione, 4.9–5.1 parts of PEI-12, 78.0 parts of water, and 13.7–13.8 parts of urea. Prolonged stirring was required to dissolve the zinc pyrithione in this pad bath, whereas it had dissolved readily in the baths described in Examples 1 and 2. The wet pickups were 92–94%, and the treated fabric had weight gains of 2.2–3.1%. Properties of the treated fabrics before and after repeated laundering are summarized in Table II.

TABLE II

PROPERTIES OF FABRIC TREATED WITH SOLUTIONS CONTAINING 1.5 PARTS OF POLYETHYLENIMINE PER PART OF ZINC PYRITHIONE

| Launderings | Zn, %[a] | S, %[b] | N, % | $Fe^{3+}$ color test | Growth inhibition[c] *S. aureus* | Growth inhibition[c] *T. mentagrophytes* |
|---|---|---|---|---|---|---|
| 0 | 0.06–0.08 | 0.28 – 0.84 | 0.41–0.42 | Pos. | 100% | Complete |
| 1 | ND | 0.30 | 0.26 | Pos. | — | Complete |
| 5 | ND | (0.10) | 0.21 | Neg. | — | Substantial |
| 10 | ND | (0.10) | 0.19 | Neg. | 100 | Substantial |
| 20 | ND | (0.10) | 0.17 | Neg. | 100 | None |
| 50 | ND | (0.10) | 0.13 | — | 35 | None |

[a]ND means not detected.
[b]Values in parentheses are considered too low to be meaningful.
[c]Reduction in number of colonies, as compared with number of colonies on cotton control fabric.

The results show that decreasing the ratio of polyethylenimine to zinc pyrithione in the pad bath from 2:1 to 1.5:1 did not significantly reduce the amount of pyrithione insolubilized in the fabric, but decreased the durability to laundering of the bacteriostatic properties imparted by the treatment. That the zinc pyrithione dissolved very slowly when the lower ratio was used was an indication that the ratio was near the minimum required for solubilization of zinc pyrithione at the concentration used.

EXAMPLE 4

A swatch of cotton fabric was treated by the procedure of Example 1 with a solution containing 0.99 g of zinc pyrithione, 2.00 g of PEI-12, and 27.04 g of water. The wet pickup was 87%. The treated fabric contained 0.17% nitrogen, but had no measurable sulfur content or zinc content. It gave us a negative $Fe^{3+}$ color test for pyrithione. In a Quinn test with *S. aureus,* it gave only a 20% reduction in the number of bacterial colonies observed with untreated fabric.

The results show that the presence of urea in the treating bath is essential to conversion of the pyrithione complex to an insoluble material when the impregnated fabric is heated.

EXAMPLE 5

A swatch of cotton fabric was treated by the procedure of Example 1 with a solution containing 4.57 g of urea, 1.65 g of PEI-12, and 18.78 g of water. The wet pickup was 95%. The treated fabric had a weight gain of 1.2% and contained 0.28% nitrogen. In a Quinn test with *S. aureus,* it gave no reduction in the number of bacterial colonies observed with untreated fabric.

The results show that even though some insoluble material is deposited in the fabric when the treating bath contains no pyrithione or pyrithione derivative, it imparts no antibacterial activity to the treated fabric.

EXAMPLE 6

A swatch of cotton fabric was treated by the procedure of Example 1 with a solution containing 0.77 g of the sodium salt of pyrithione, 1.64 g of PEI-12, 18.03 g of water, and 4.58 g or urea. The wet pickup was 95%. The treated fabric had a weight gain of 1.4% and contained 0.38% nitrogen, but had no measurable sulfur content and gave a negative $Fe^{3+}$ color test for pyrithione. In a Quinn test with *S. aureus,* it gave no reduction in the number of bacterial colonies observed with untreated fabric.

The results show that when an ionic pyrithione salt is substituted for the zinc pyrithione in the treating bath the treated fabric contains no insolubilized pyrithione.

We claim:

1. A process for imparting to cellulosic textiles antimicrobial properties that are durable to laundering comprising:

(a) impregnating the cellulosic textile material with a solution of zinc pyrithione, sufficient amounts of polyamine capable of solubilizing the pyrithione complex per part of zinc pyrithione, and sufficient amounts of urea to provide one urea molecule for each primary and secondary amino group in the polyamine;

(b) heating the textile at sufficient temperature to drive off the moisture and complete the reaction.

2. The process of claim 1 wherein the solution contains at least 1.5 parts of polyamine.

3. The process of claim 2 wherein the heating step is at a temperature above 100° C.

4. The process of claim 3 wherein the polyamine is a polyethylenimine with an average molecular weight of about from 600 to 1200 and the solution contains at least 1.4 parts of urea per part of polyethylenimine.

5. The process of claim 4 wherein the cellulosic material is cotton.

* * * * *